United States Patent [19]

Chierici

[11] 4,133,434

[45] Jan. 9, 1979

[54] SNAP-ON COUPLER BEARING PLATE FOR RAILROAD CAR COUPLER CARRIERS

[75] Inventor: Osvaldo F. Chierici, Elmhurst, Ill.

[73] Assignee: Holland Company, Aurora, Ill.

[21] Appl. No.: 845,488

[22] Filed: Oct. 26, 1977

[51] Int. Cl.[2] ..... B61G 7/10

[52] U.S. Cl. ..... 213/61; 213/21; 213/60; 308/DIG. 8; 308/3 R

[58] Field of Search ..... 213/60, 61, 21, 62 R; 308/DIG. 8, 3 R

[56] References Cited

U.S. PATENT DOCUMENTS

| | | | |
|---|---|---|---|
| 1,931,479 | 10/1933 | Barrows | 213/60 |
| 2,299,541 | 10/1942 | Harwick | 213/61 |
| 2,718,968 | 9/1955 | Metzger | 213/61 |
| 3,394,821 | 7/1968 | Cordani | 213/60 X |
| 4,055,254 | 10/1977 | Chierici et al. | 213/61 |

OTHER PUBLICATIONS

1974 Edition of Car and Locomotive Encyclopedia, Simmons-Boardman Publishing Company, p. s8-19.

*Primary Examiner*—Galen L. Barefoot
*Assistant Examiner*—Sherman D. Basinger
*Attorney, Agent, or Firm*—McWilliams & Mann

[57] ABSTRACT

A snap-on coupler bearing plate for application to resiliently supported coupler carriers of AAR standard F type interlocking coupler applications, in which the bearing plate is in the form of a channel shaped member formed from an ultra high molecular weight polymer of dry self lubricating characteristics that is shaped to overlie and be snap fitted to the load support plate of the coupler carrier. The bearing plate is of integral one piece construction and defines an upwardly facing slide surface on which the coupler wear plate rides that is characterized by effecting resurfacing of the coupler wear plate surfacing engaging same to make such wear plate surfacing effectively resistant against wear.

8 Claims, 6 Drawing Figures

SNAP-ON COUPLER BEARING PLATE FOR RAILROAD CAR COUPLER CARRIERS

This invention relates to coupler carriers for railroad cars, and more particularly, to a bearing plate arrangement, adapted for application to conventional coupler carriers of the type involved in the AAR standard F type interlocking coupler applications, on which bearing plate the coupler shank is to ride.

Couplers of railroad cars are commonly operatively connected to the car and associated with the well known striker casting that is fixed to the projecting end of the car center sill at the car end in question. The striker castings involved are normally of open centered configuration defining the usual striking face disposed in a vertical plane, with the coupler shank extending through the casting and having affixed to the underside of same a wear plate that rests on the so called coupler carrier that is supported by a striker casting at the threshold of the striker casting window opening.

This invention is concerned with the resiliently supported type coupler carrier in which the coupler supporting portion of the carrier is in the form of the familiar carrier iron that is secured on top of the carrier casting, and forms the carrier load support plate; the carrier casting is in turn resiliently supported in the striker casting cage that is defined by an upwardly facing socket formed in the lower side of the striker casting at the threshold of the striker casting window opening. The socket in question defines a coupler carrier chamber formed with inner and outer side walls disposed crosswise of the center line of draft between which the carrier casting is received. The carrier casting defines oppositely facing side walls that are in close fitting relation to the indicated coupler carrier chamber side walls, and inwardly indented end portions at either side of the striker casting that are formed for cooperation with vertical movement limiting stops secured to the car center sill on either side of the striker casting. Several coil springs interposed between the carrier casting and the bottom of the striker casting cage in question resiliently support the coupler carrier and coupler that rests on the coupler carrier iron.

This type of coupler carrier arrangement is commonly employed in AAR standard F type interlocking coupler applications, an illustration of which is shown at page S8-19 of the 1974 Edition of Car & Locomotive Encyclopedia published by Simmons-Boardman Publishing Company. Resiliently supported coupler carrier arrangements of this type are commonly employed in cars designed for use in the so called unit trains.

As indicated, couplers in applications of this type have applied to the underside of the coupler shank the familiar hardened steel wear plate that rides on the coupler carrier load support surface defined by the carrier iron. This wear plate is by its nature a wear away item that conventionally requires periodic replacement even under the best of circumstances.

Replacement of coupler shank wear plates has long been a problem in the railroad field. When the wear plate is to be replaced, welding is required to mount the replacement wear plate in place, and this means that the coupler shank must be heat treated to relieve stresses induced in same by the welding involved; failure to follow appropriate heat treatment procedures on replacing the coupler wear plate can lead to failure of the coupler in service.

Of course, coupler wear plate replacement requires shopping of the car with consequent expense and loss of revenue while the car is shopped, together with the risk that the heat treating procedures required for the coupler shank after the rewelding that has been done (to replace or repair a coupler wear plate) will be inadvertently omitted.

A principal object of the invention is to provide a special bearing plate arrangement for snap fit application to the coupler carrier load support plate that provides an essentially wear free bearing surface on the coupler carrier on which the coupler shank wear plate rides, and that effects a resurfacing of the coupler shank wear plate that makes same effectively resistant against wear.

Another principal object of the invention is to provide a bearing plate arrangement for application to coupler carriers of the resiliently supported type for shiftably supporting the coupler shank thereon, and that requires no bonding, in the form of welding or the like, or mechanical fastening devices, to mount the bearing plate in place on the coupler carrier.

Other objects of the invention are to provide a coupler shank supporting bearing plate for resiliently supported coupler carriers that is of dry self lubricating characteristics, that is of unitary one piece construction arranged for hammer-in-place, snap-fit type application, to the coupler carrier, and that is economical of manufacture, convenient to use, and long lived in application.

In accordance with the invention, a bearing plate of special characteristics is provided for application to the load support plate of the coupler carrier in which the bearing plate is in the form of a channel shaped member formed from ultra high molecular weight polyethylene, and that is shaped to overlie and be snap fitted to the indicated coupler carrier load support plate. The bearing plate provided by the invention is of integral one piece construction and defines along the flange portion of same that is to be at the inner side of the coupler carrier a forwardly projecting ledge portion that is to hook under and underlie the coupler carrier load support plate rim on that side of the coupler carrier.

The bearing plate along the flange portion of same that is to be at the other side of the coupler carrier load support plate is formed to define a downwardly facing wedge surface therealong for camming the bearing member outer flange portion over the coupler carrier support plate rim at the front side of the coupler carrier when the bearing plate is hammered in place along its outer edge portion.

When mounted in operating position, the bearing plate defines an upwardly facing slide surface on which the coupler shank wear plate rides, which slide surface is characterized by effecting resurfacing of the coupler shank wear plate to make the wear plate effectively resistant against wear.

Other objects, uses, and advantages will be obvious or become apparent from a consideration of the following detailed description and the application drawings in which like reference numerals indicate like parts throughout the several views.

However, it is to be distinctly understood that the specific drawing illustrations provided are supplied primarily to comply with the requirements of the Patent Laws, and that the invention is susceptible of modifications and variations that will be obvious to those skilled in the art, and that are intended to be covered by the appended claims.

Figure 1:
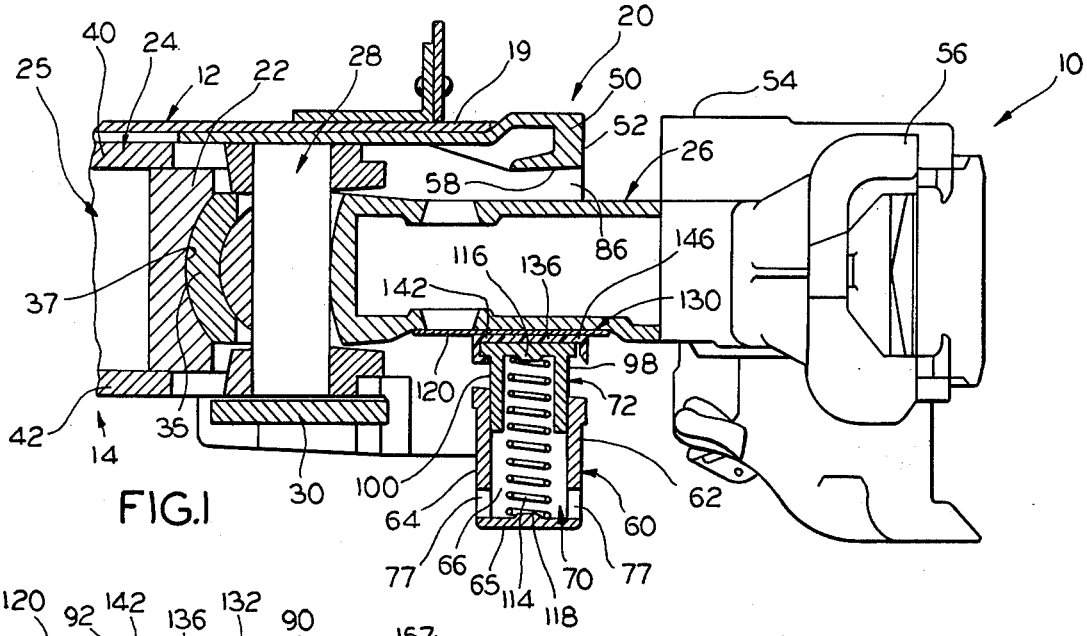
FIG. 1 is a vertical sectional view of the end of the car center sill showing the coupler, striker casting, and coupler carrier, as applied thereto, with parts shown in elevation.

Reference numeral 10 of FIG. 1 generally indicates an AAR type F interlocking coupler applied to conventional center sill 12 that is an integral part of railroad car body 14 (the latter being largely omitted except for the relevant parts in the area of the operating location of the coupler 10).

The center sill 12 is of the usual inverted channel shaped type and requires no further explanation. Suitably fixed to the terminal end portion 19 of the center sill 12 is conventional striker casting 20 that includes the usual forward draft gear stop lugs (not shown) against which is seated the usual front follower 22 that is operably associated with conventional draft gear 25 that has its other end seated against the usual rear stop lugs that are not shown. The draft gear 25 (which is shown only diagrammatically as its specifies have nothing to do with the present invention) and its front follower 22 are embraced as is conventional, by vertical yoke 24 which is connected to the shank 26 of the coupler 10 by connector pin 28 that is supported by support plate 30 that is suitably secured in place across the center sill 12 at the level indicated. As usual, the spherically contoured inner end 35 of the coupler shank seats against the correspondingly contoured force transmitting recess 37 of the front follower 22.

The yoke 24 comprises the usual upper and lower straps or arms 40 and 42 that are suitably apertured to receive the connector pin 28, and which are integrally connected at the inner end of the yoke 24 in the usual manner (not shown).

The striker casting 20 comprises the usual vertically disposed striker portion 50 having the planar striking face 52 which is adapted to be engaged by the usual horn 54 of the coupler head 56. The striker portion 50 is of generally planar configuration and defines an open center or window 58 through which the coupler shank 26 extends for connection to the yoke, and thus to center sill 12 through draft gear 25.

The striker portion 50 of casting 20 defines in coplanar relation therewith at the underside of same a cage 60 defined by a forward or outer wall 62 spaced from a rear or inner wall 64 and side walls 66 on either side of the striker casting, which in turn form the coupler carrier chamber 70 in which is resiliently mounted coupler carrier 72 that in itself is entirely conventional, and that is provided to resiliently support the coupler shank 26.

The striker casting 50 and coupler carrier 72 per se may be of the specific types shown at page S8-19 of the aforementioned Edition of Car & Locomotive Cyclopedia. The striker casting 20 thus includes the usual side and back flanges that are suitably affixed to the center sill in any suitable manner, and cage 60 is formed to define the usual drain openings 77.

Figure 3:
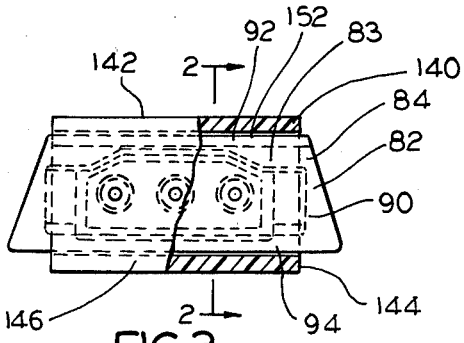
FIG. 3 is a top plan view of the coupler carrier showing the bearing plate applied thereto and partially indicated in broken lines.
Figure 4:
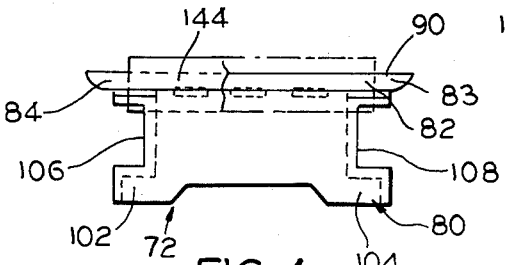
FIG. 4 is a front elevational view of the coupler carrier showing the bearing plate of this invention applied thereto in a manner similar to that of FIG. 3.

The coupler carrier shown in FIGS. 3 and 4 is for the familiar wide swing coupler application and thus comprises the body 80 in the form of the usual high tensile steel casting that defines an upper platform portion 82 defined by the usual carrier iron or load support plate 83 that is flanged as at 84 about its margin and that is proportioned and shaped to fit within the window opening 58 of the striker casting in close fitting relation to the side walls 86 of same. The load support plate 83 of the coupler carrier thus forms an upwardly facing load support surface 90 on which the coupler shank wear plate normally rides, and inner and outer projecting edge portions 92 and 94 that respectively project inwardly and outwardly of the window opening 58 with respect to the body 80, and in overhanging relation to the coupler carrier body 80.

The coupler carrier body 80 below the platform portion 82 is of oblong configuration defining forward wall 98 and rearward wall 100 that respectively oppose the cage walls 62 and 64 when the coupler carrier 72 is mounted in its operative position of FIG. 1. The body 80 at its ends 102 and 104 below the platform portion 82 is notched as indicated at 106 and 108 for cooperation with the conventional stop retainer plates (not shown) that are fixed to the center sill 12 in the manner indicated in the above referred to Car & Locomotive Cyclopedia reference to serve as stops defining the upper and lower limits of movement of the coupler carrier 72 under the action of the conventional compression springs 114 that are interposed between the body 80 and the floor 65 of cage 60 for the purpose of resiliently supporting the coupler carrier 72 and its coupler load. As indicated in FIG. 1, the body 80 is of hollow construction to receive the springs 114, which are each applied between a spring seat 116 formed within the body 80 under the load support plate 82, and the spring seat 118 formed in the cage floor 65.

Conventionally, the coupler shank 26 is provided with wear plate 120, usually welded in place, which physically engages the platform portion 82 of the coupler carrier 72.

In accordance with this invention, the coupler carrier 72 is equipped with bearing plate 130 that is applied to the coupler carrier load support plate 83 to provide a slide surface 132 of special characteristics on which the coupler shank wear plate 120, and specifically its surface 134, rides, in supporting the coupler on the coupler carrier 72.

Bearing plate 130 is of integral one piece construction and comprises a channel shaped bearing member 136 in the form of a planar panel or web portion 138 of generally quadrilateral configuration and having depending flange portion 140 along the inner edge 142 of same and depending flange portion 144 along the outer edge 146 of same. In the embodiment of FIGS. 2 through 5, the bearing member 136 along the lower edging 150 of flange portion 140 defines a forwardly or outwardly projecting ledge portion 152 that extends the length of the bearing member 136. The forward or outer depending flange portion 144 along its lower edging 154 defines wedge surface 156 along the length of the member 136, which surface 156 faces downwardly to have the plane thereof intersect the panel portion 138 of the member 136 intermediate the inner and outer edges 142 and 146 of same. In the form shown, the surface 156 is angled relative to the plane of panel portion 138 to intersect at an angle of approximately 45 degrees with respect to same.

Figure 2:
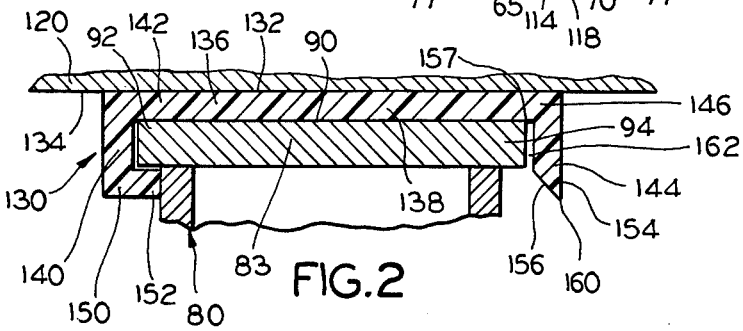
FIG. 2 is a fragmental sectional view showing the coupler carrier and bearing plate arrangement of this invention as applied thereto, as shown in FIG. 1, but on an enlarged scale.

The flange portions 140 and 144 of the member 136 are spaced apart to receive the coupler carrier load support plate 83 therebetween, as indicated in FIGS. 1 through 3. The ledge portion 152 of flange portion 140 is proportioned to underlie the rear edging 92 of the coupler carrier load support plate 82 when the member 136 is mounted in its operative position. The wedge surface 156 is provided to cam the bearing member flange portion 144 over the outer edging 94 of the coupler carrier load support plate 83, and specifically its upper corner 157, when the bearing plate 130 is applied to the coupler carrier 72, as will be hereinafter described.

Further in accordance with the invention, the member 136 is formed in one piece configuration from ultra high molecular weight (UHMW) polyethylene having a molecular weight in the range of from about 3,000,000 to about 9,000,000. In the preferred embodiment, the member 136 is formed from the molecularly oriented UHMW polyethylene marketed by Ketrol Engerprises of York, Pa. under the trademark TUFLAR (grade PL).

The material specified is a high density polymer of dry self lubricating characteristics that is sufficiently compaction resistant to resist any substantial compaction under compressive forces up to its elastic limit, and has a high degree of elastic memory for full return to original shape after being stressed, up to its elastic limit. This material also has a high degree of toughness and long wearing characteristics, and is also receptive to fillers in the form of glass, clay, sand, suitable fabrics, and alumina, for modifying same to adapt the member 136 for specific conditions.

The material from which the member 136 is made is pliable but non-stretchable, and is thus free from distending or stretching characteristics. The material involved has a coefficient of sliding or dynamic friction with respect to steel of about 0.02.

In applying the bearing plate 130 to the coupler carrier 72, this may be done either prior to application of the coupler carrier to the striker casting, or after application of the coupler carrier to the striker casting but before the coupler is mounted in position. Under either condition of application, the bearing member 136 is suitably centered over the coupler carrier load support plate 83, but shifted transversely of same so that the inner side edging 92 of the coupler carrier load support plate 82 may be received between the panel portion 138 and ledge portion 152 of member 136; in this position, the outer flange portion 144 will then rest on top of the coupler carrier load support plate 83 along the outer side edging 94 of same with the knife edge 160 of flange portion 144 that is defined by the wedge surface 156 disposed in substantial alignment with or closely adjacent to the margin 162 of the coupler carrier load support plate outer edging 94. If necessary, plate 130 may be shifted outwardly of the sill (to the right of FIG. 1) to achieve this positioning by hammer tapping of flange portion 140.

The installer than hammers the member 136 down against the coupler carrier load support plate 83 along the outer side edging 146 of same to cam depending flange portion 144 sufficiently outwardly of the coupler carrier edge portion 162 so that the bearing member panel portion 138 seats flush against the surface 90 of the coupler carrier load support plate 83 and the flange portion 144 has the positioning relative to the other parts of bearing member 136 that is shown in FIGS. 1 and 2. As indicated, the flange portions 140 and 144 are in substantial parallelism and are perpendicular to the panel portion 138, with the ledge portion 152 being disposed in a plane that parallels panel portion 138 and intersects the plane of the flange portions 140 and 144 at right angles thereto. It is also to be noted that the wedge surface 156 is located on the flange portion 144 to lie within the projection of ledge portion 152.

Figure 5:
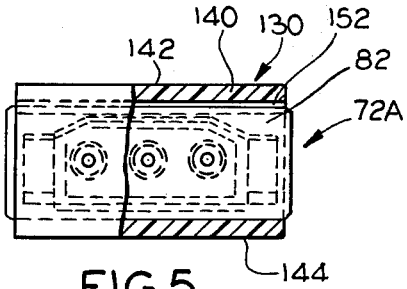
FIG. 5 is a view similar to that of FIG. 3 showing the invention applied to a different form of coupler carrier.

In FIG. 5, the bearing plate 130 is shown applied to coupler carrier 72A that has its load support plate 82 shaped for use with standard side swing couplers.

Figure 6:
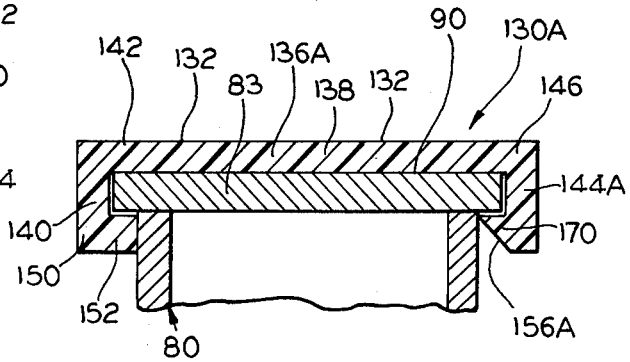
FIG. 6 is a view similar to that of FIG. 2 illustrating a modified form of the invention.

FIG. 6 shows a modified bearing plate 130A that is the same as bearing plate 130 except that its depending flange portion 144A that corresponds to flange portion 144 of bearing plate 130 includes short ledge portion 170 that projects inwardly and toward ledge portion 152. In this embodiment, the wedge surface 156A that corresponds to wedge surface 156 of the member 136 is formed on ledge portion 170, with ledge portion 170 underlying the outer edging 94 of the coupler carrier load support plate 82 when the bearing plate 130 is applied thereto, as indicated in FIG. 6 (which may be done in a manner similar to that described for plate 130).

Bearing plate 130A is otherwise the same as bearing plate 130, as indicated by corresponding reference numerals, the bearing member 136A being formed from the same material as bearing member 136.

The bearing plates 130 and 130A provide a number of significant improvements.

For instance, in use, as the coupler moves with respect to the coupler carrier 72, the surface 132 effects on the coupler shank wear plate surface 134 a polishing or honing resurfacing action, such that, after a period of normal use, the surface 134 instead of being worn, tends to become resurfaced so as to be effectively resistant against further wear.

What appears to happen is that as the coupler shank moves longitudinally of and sidewise of the coupler carrier 72, the polymer material of the bearing plates 130 and 130A tends to fill up the pores and level the irregularities in the metal surfacing forming the wear plate surface 134, so that the wear plate surface 134 becomes partially reformed and defined by transferred polymer material from the bearing plates 130 and 130A.

Any metal that is worn off wear plate 120 by the shifting action involved becomes embedded in the panel 138 if it remains on or near the surfacing 132, and any foreign matter that is caught between the wear plate 120 and the bearing plate surfacing 132 becomes embedded in the panel 138, and thus is positioned to avoid wearing engagement with the wear plate surface 134.

The bearing plates 130 and 130A, in being formed from the indicated dry self lubricating material, eliminate the need for applying separate lubricating materials to wear plate 120 or mounting plate 83, thereby permitting the area of the coupler shank wear plate 132 and the coupler carrier plate 83 to be free of wet type lubricants that might otherwise be employed for this purpose, which commonly accumulate foreign matter that aggrevages wear problems. The polymer material employed in practicing the invention also resists adherence thereto of foreign matter that thus will not accumulate where it could adversely affect the coupler shank wear plate surface 134.

It has also been found that the surfacing 132 of the bearing plates 130 and 130A tends to harden in use, thus increasing its ability to resist wear. This is also true of the polymer material that is transferred to wear plate surface 134, thus further minimizing wear at this surface. The resulting resurfacing of surface 134 also means that the coefficient of sliding friction at surfaces 132 and 134 tends to decrease even below the 0.02 figure as the polymer material builds up on the surface 34.

The result is that wear of the wear plate surface 134 is eliminated, thus relieving the railroads of having to replace the wear plates 120 due to their having been worn to the condemnation stage.

Furthermore, the invention now makes it possible for an individual trainman to manually shift couplers supported on coupler carriers equipped with bearing plates 130 and 130A, for proper alignment with the coupler of another car, to be coupled with the car in question, (a frequent requirement in the field). It is well known that couplers are rather heavy and difficult to move at best, and strained backs are commonly experienced by trainmen attempting to manually move couplers for this purpose. However, couplers equipped in accordance with this invention may be readily shifted to one side of the other of the center line of draft by the trainman using one hand, and without requiring any lifting action on the coupler head at all.

It will therefore be seen that the invention provides a bearing plate for application to coupler carriers which eliminates wear on the coupler shank wear plate, with consequent relieving of the railroads of coupler shank wear plate replacement problems due to wearing out of the wear plate.

As the coupler carrier load support plate is covered by the bearing plate of the invention, the coupler carrier support plate is also freed from wear problems.

In addition to the other advantages described hereinbefore, the bearing arrangement of this application reduces friction in the back and forth and side to side movements of the coupler, and thus contributes to basic energy conservation in terms of train operation. Also, the bearing arrangement of the invention provides quieter riding characteristics since metal to metal engagement at the coupler carrier is eliminated and the material from which the plates 130 and 130A are formed has sound deadening characteristics.

The invention is particularly useful in connection with railroad cars that are to be used in unit trains, which may experience service of up to 130,000 to 150,000 miles per year or more. It is in applications of this sort where wear problems have become particularly critical due to high mileage conditions in service, and where it is particularly important that all of the cars in the train are equipped to avoid the need for frequent shopping of the car.

The bearing plate arrangement provided by the invention permits conventional cars equipped with conventional coupler carriers and coupler wear plates to be equipped for essentially wear free operation in the area of the coupler carrier and coupler shank wear plate by the use of an inexpensive readily applied one piece bearing component that requires no bonding or mechanical fasteners to hold it in place, and that requires no modification of the conventional coupler shank, coupler shank wear plate, and coupler carrier structures in order to be applied to the car.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a railroad car wheeled for riding on track rails and having a body including a center sill projecting from one end of the car and equipped with a coupler striker casting and a coupler mounted on the center sill for swinging movement sidewise of the car, said coupler including a shank extending through the casting and having a wear plate anchored to its underside, with the casting including a striking face disposed in a vertical plane and disposed transversely of the car center line of draft, said casting adjacent said face having a cage portion defining below the coupler shank an upwardly opening socket defining a coupler carrier chamber, and a coupler carrier resiliently mounted in said chamber on which the coupler shank wear plate rests, with the coupler carrier having an upwardly facing planar load support plate defining a flat horizontally disposed load support surface on which the coupler shank wear plate rides for supporting the coupler on the coupler carrier, with said coupler carrier load support plate defining opposed inner and outer edge portions respectively projecting in the plane of said load support plate in overhanging relation to said coupler carrier, a coupler bearing plate for said load support plate, said bearing plate comprising:

a bearing member of inverted channel shape configuration defining a planar web portion, an inner depending flange portion along the inner side of the same and an outer depending flange portion along the outer side of same, said member inner flange portion including a forwardly projecting ledge portion underlying said member web portion and spaced below said member web portion to receive the inner edge portion of the coupler carrier load support plate therebetween, said member outer flange portion projecting downwardly to the level of said member ledge portion and being formed to define a downwardly facing wedge surface therealong that inclines upwardly in the direction of said member inner flange portion for camming said member outer flange portion over the outer edge portion of the coupler carrier load support plate when said member is applied to said load support plate with said load support plate inner edge portion lodged between said web portion and ledge portions thereof with said web portion thereof overlying said load support plate surface and said member is hammered downwardly along the outer side of same to mount said bearing member in its operative position on said load support plate, said member being of one piece construction formed from a ultra high molecular weight polyethylene of dry self lubricating characteristics, said member web portion defining an upwardly facing slide surface on which the coupler shank wear plate engages when said bearing plate is in its said operative position.

2. The bearing plate set forth in claim 1 wherein:

said wedge surface is angled at approximately 45 degrees relative to said member web portion.

3. The bearing plate set forth in claim 1 wherein:

said wedge surface lies within the thickness dimensions of said member outer flange portion.

4. The bearing plate set forth in claim 1 wherein:

said member outer flange portion includes an inwardly projecting ledge portion that is substantially coplanar with said member inner flange portion ledge portion, on which said wedge surface is formed.

5. The bearing plate set forth in claim 1 wherein:

said polyethylene has a molecular weight in the range of from approximately 3,000,000 to approximately 9,000,000, with said slide surface having a coefficient of sliding friction with the coupler wear plate that is no greater than about 0.02.

6. In combination with a railroad car, wheeled for riding on track rails and having a body including a center sill projecting from one end of the car, and equipped with a coupler striker casting and a coupler mounted on the center sill for swinging movement sidewise of the car, said coupler including a shank extending through the casting and having a wear plate anchored to its underside, with the casting including a striking face disposed in a vertical plane and disposed transversely of the car center line of draft, said casting adjacent said face having a cage portion defining below the coupler shank an upwardly opening socket defining a coupler carrier chamber, and a coupler carrier resiliently mounted in said chamber on which the coupler shank wear plate rests, with the coupler carrier having an upwardly facing planar load support plate defining a flat horizontally disposed load support surface on which the coupler shank wear plate is supported for supporting the coupler on the coupler carrier, with said coupler carrier load support plate defining opposed inner and outer edge portions respectively projecting in the plane of said load support plate in overhanging relation to said coupler carrier, a coupler bearing plate for said load support plate, on which said coupler shank wear plate rides to support the coupler on the coupler carrier, said bearing plate comprising:

a bearing member of inverted channel shaped configuration defining a planar web portion, an inner depending flange portion along the inner side of same and an outer depending flange portion along the outer side of same, said member inner flange portion including a forwardly projecting ledge portion underlying said member web portion and spaced below said member web portion and receiving the inner edge portion of the coupler carrier load support plate therebetween, said member outer flange portion projecting downwardly to the level of said member ledge portion and being formed to define a downwardly facing wedge surface therealong that inclines upwardly in the direction of said member inner flange portion whereby said member outer flange portion is cammed over the outer edge portion of the coupler carrier load support plate when said member is applied to said load support plate with said load support plate inner edge portion lodged between said web portion and ledge portions thereof with said web portion thereof overlying said load support plate surface and said member is hammered downwardly along the outer side of same to mount said bearing member in its operative position on said load support plate, said member being of one piece construction formed from an ultra high molecular weight polyethylene of dry self lubricating characteristics, said member web portion defining an upwardly facing slide surface on which the coupler shank wear plate engages, said member being characterized by having said slide surface thereof effecting during use resurfacing of the portion of said wear plate engaged thereby for reforming said wear plate portions to have a wear free finish.

7. The combination set forth in claim 6 wherein:

said member slide surface has a coefficient of sliding friction with the coupler wear plate that is no greater than about 0.02.

8. The combination set forth in claim 6 wherein:

said member flanges are spaced apart for snap fit application of said member to said coupler carrier load support plate.

* * * * *